US006609475B2

(12) United States Patent
Thomas et al.

(10) Patent No.: US 6,609,475 B2
(45) Date of Patent: Aug. 26, 2003

(54) INTEGRATED BUMPER BOAT HULL AND METHOD

(76) Inventors: Roger W. Thomas, 15454 266th Ave. SE., Issaquah, WA (US) 98027; Michael Sherlock, 2522 Viewcrest Ave., Everett, WA (US) 98203

( * ) Notice: Subject to any disclaimer, the term of this patent is extended or adjusted under 35 U.S.C. 154(b) by 0 days.

(21) Appl. No.: 10/125,830

(22) Filed: Apr. 19, 2002

(65) Prior Publication Data

US 2002/0152943 A1 Oct. 24, 2002

Related U.S. Application Data

(60) Provisional application No. 60/285,406, filed on Apr. 20, 2001.

(51) Int. Cl.[7] ..... B63B 59/02

(52) U.S. Cl. ..... 114/219; 114/355; 114/357

(58) Field of Search ..... 114/219, 356, 114/357

(56) References Cited

U.S. PATENT DOCUMENTS 4,365,580 A 12/1982 Blount ..... 114/356
5,647,297 A 7/1997 Hansen ..... 114/283
5,870,965 A 2/1999 Hansen ..... 114/283
5,878,685 A 3/1999 Hemphill et al. ..... 114/219
6,364,293 B1 * 4/2002 Beckett ..... 267/140
6,371,040 B1 * 4/2002 Hemphill et al. ..... 114/219

* cited by examiner

*Primary Examiner*—Stephen Avila
(74) *Attorney, Agent, or Firm*—Dean A. Craine

(57) ABSTRACT

An aluminum boat hull is disclosed having an integrally molded bumper formed on the sidewalls that is securely attached and protected. The bumper is made of a first and second layer of foam covered with an outer protective layer. Formed on the outside surface of the hull sidewalls are a plurality of chambers formed between upper and lower longitudinal frame members and a plurality of intermediate frame members attached between the longitudinal frame members. Perpendicularly aligned and attached to the outside edge of each intermediate frame member is an anchor plate. Also formed on the inside surfaces of the upper and lower longitudinal frame members are upper and lower stiffeners. During manufacturing, closed-cell first foam is poured into the chambers to cover. An optional layer of fiberglass is placed over the outer surface of the first foam layer and allowed to cure. A closed-cell, second foam layer is then created over the fiberglass layer. A hardening layer is then painted over the second foam layer. A method of manufacturing the integrated boat hull bumper is also disclosed.

14 Claims, 4 Drawing Sheets

INTEGRATED BUMPER BOAT HULL AND METHOD

This is a utility patent application based on a provisional patent application (Ser. No. 60/285,406) filed on Apr. 20, 2001.

BACKGROUND OF THE INVENTION

1. Field of the Invention

This invention pertains to boat hulls and, more specifically, to boat hulls with outer foam bumpers and methods of manufacturing such boat hulls.

2. Description of the Related Art

Traditional boat hull bumpers provide an external fender system for protecting the hull of a boat. The fender system must provide sufficient protection for the hull of the boat when mooring the boat or bringing the boat along side another boat for boarding while not interfering with the normal operation of the boat. Traditional boat hull bumpers are made of polymeric foam material separately affixed to the sides of the hull with stainless steel bolts and nuts. In most instances, the bumpers appear as separate structures attached to the sides of the hull. When used in salt water, galvanic corrosion occurs between the bolts and the aluminum hull that often results in the bumper detaching from the hull. Because the bumpers are made of foam, they often split and begin to hang downward from the sides of the hull. This, of course, detracts from the boat's appearance.

What is needed is an aluminum boat hull with a foam bumper that is more securely attached to the sides of the hull than current boat hull bumper designs and has the appearance of being integrally formed into the hull.

SUMMARY OF THE INVENTION

It is an object of the present invention to provide a boat hull with a protective bumper.

It is another object of the present invention to provide such a boat hull wherein the bumper is made of foam and is securely attached to the sides of the hull and does not have the detachment problems found in the prior art.

It is another object of the present invention to provide such a boat hull with a bumper system that appears to be integrally formed into the hull.

It is further object of the present invention to provide an economical method of manufacturing such a boat hull with an integrally attached protective bumper.

These and other objects of the invention which will become apparent are met by an aluminum boat hull that includes rigid framing formed on the sides of the hull that creates a plurality of outward extending chambers in which a continuous foam bumper is created around the sides of the hull. The rigid framing acts not only as a mold used to manufacture the foam bumper, but also as a support structure that securely holds and prevents separation or disengagement of the bumpers from the hull during normal use.

In the preferred embodiment, the rigid frame comprises upper and lower longitudinal members spaced apart and attached along one edge to the sidewalls of the hull from the stern to the bow. Disposed between the upper and lower longitudinal members are a plurality of intermediate members. The intermediate members are evenly spaced apart along the entire length of the hull. In the preferred embodiment, the intermediate members are perpendicularly aligned between the upper and lower longitudinal frame members to form a plurality of outward extending chambers along the sides of the hull. At least one passageway is formed on each intermediate member so that liquid foam material poured into one chamber also flows into an adjacent chamber.

Attached to the outer edges of each longitudinal member is a perpendicularly aligned anchor plate. Each anchor plate is centrally aligned on the outer edge of the intermediate frame member and smaller in width and height than the chambers thereby partially enclosing the outward extending chambers. Optional longitudinally aligned stiffeners may also be attached to the upper and lower longitudinal frame members to provide additional support and stop surfaces for the first foam layer discussed further below.

During the manufacturing process, foam material is poured or sprayed into the chambers until all of the chambers on one side of the hull are filled with foam to create a first foam layer. Sufficient foam material is poured into the chambers until the top and bottom surfaces of the upper and lower longitudinal members, respectively, are covered and the entire intermediate frame members, the anchor plates, and the stiffeners are imbedded therein. After curing, the first foam layer is relatively hard and may be manually shaped to a desired profile. After the first foam layer is created, an optional layer of fiberglass is formed over the outer surface thereof. A second, flexible foam layer is then formed or molded over the fiberglass or first foam layer and around the exposed upper and lower surfaces of the upper and lower longitudinal members. An outer pigmented hardening layer is then applied over the second foam layer so that the bumper is the same color as the hull or the hull trim.

In summary, the upper and lower longitudinal frame members, the intermediate frame members, the anchor plates, and the stiffeners, act as a mold for the first foam layer. These components also act as support structures to securely attach the bumper to the hull and as protective structures that prevent separation from the hull. The second foam layer acts as a protective layer over the inner foam and the exposed surfaces of the frame members.

DESCRIPTION OF THE PREFERRED EMBODIMENT(S)

Referring to the accompanying FIGS. 1–5, there is shown and described an aluminum boat hull generally indicated as 8, which includes a transom 9 and two perpendicularly aligned, converging side walls 10, with integrated bumpers 12, 12' formed on the side walls 10.

Figure 7:
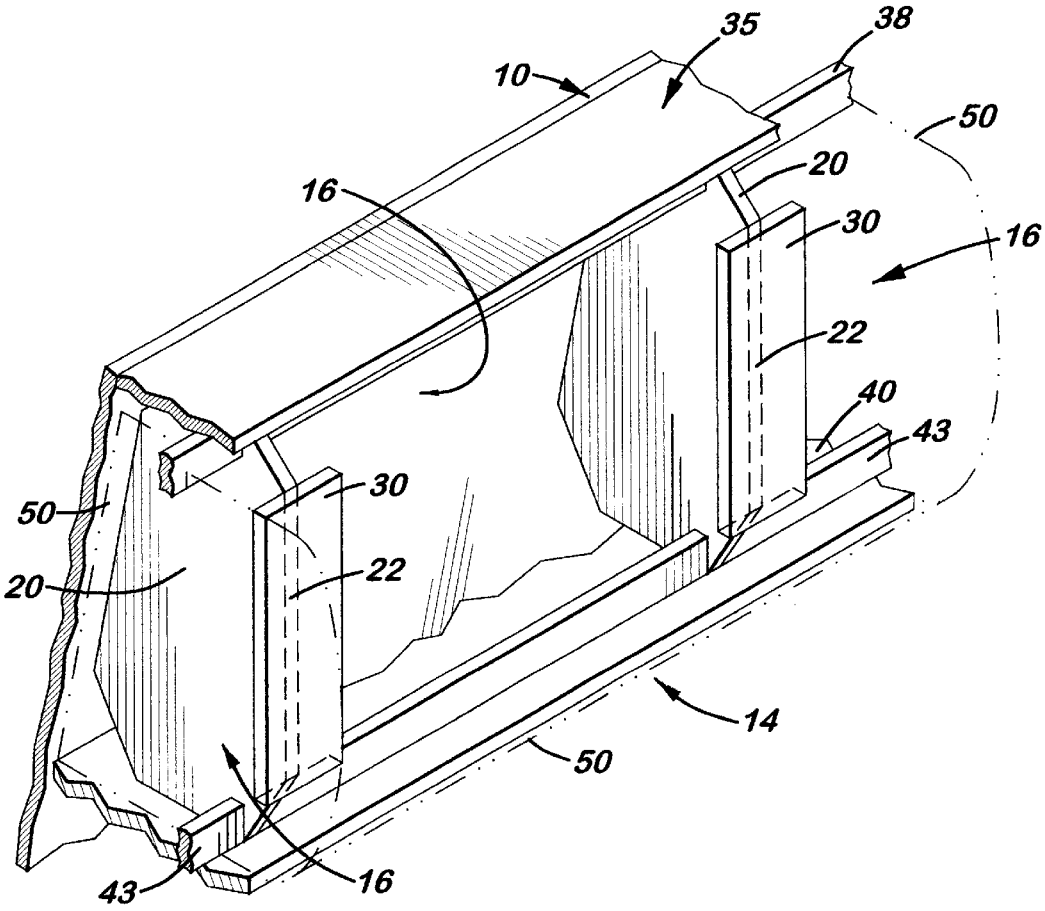
FIG. 7 is a perspective view of the rigid frame attached to the sides of the boat hull.

As shown more clearly in FIG. 7, formed on the sides of the hull 8 is rigid framing 14 that forms a plurality of outward extended chambers 16 that are filled with a first foam layer 50. More specifically, the rigid framing 14 includes two parallel upper and lower longitudinal frame members 35, 40, respectively, longitudinally aligned and welded to the outside surfaces of the side walls 10. The upper and lower longitudinal frame members 35, 40 extend longitudinally over the adjacent side wall 10 from the stern to the bow 11 of the hull 8. Aligned vertically over the outside surfaces of the side walls 10 between the two frame members 35, 40 are a plurality of intermediate frame members 20. The intermediate frame members 20 are spaced apart 12 to 24 inches and are perpendicularly aligned between the upper and lower longitudinal frame members 35, 40. Attached to the outside surface 22 of each intermediate frame member 20 is a vertically aligned anchor plate 30. The anchor plate 30 is centrally and perpendicularly aligned on the intermediate frame member 20 and is smaller in height than the adjacent chambers 16.

Attached to the bottom surface 37 of the upper longitudinal frame member 35 is an upper stiffener 38. Attached to the top surface 41 of the lower longitudinal frame member 40 is a lower stiffener 43.

Figure 1:
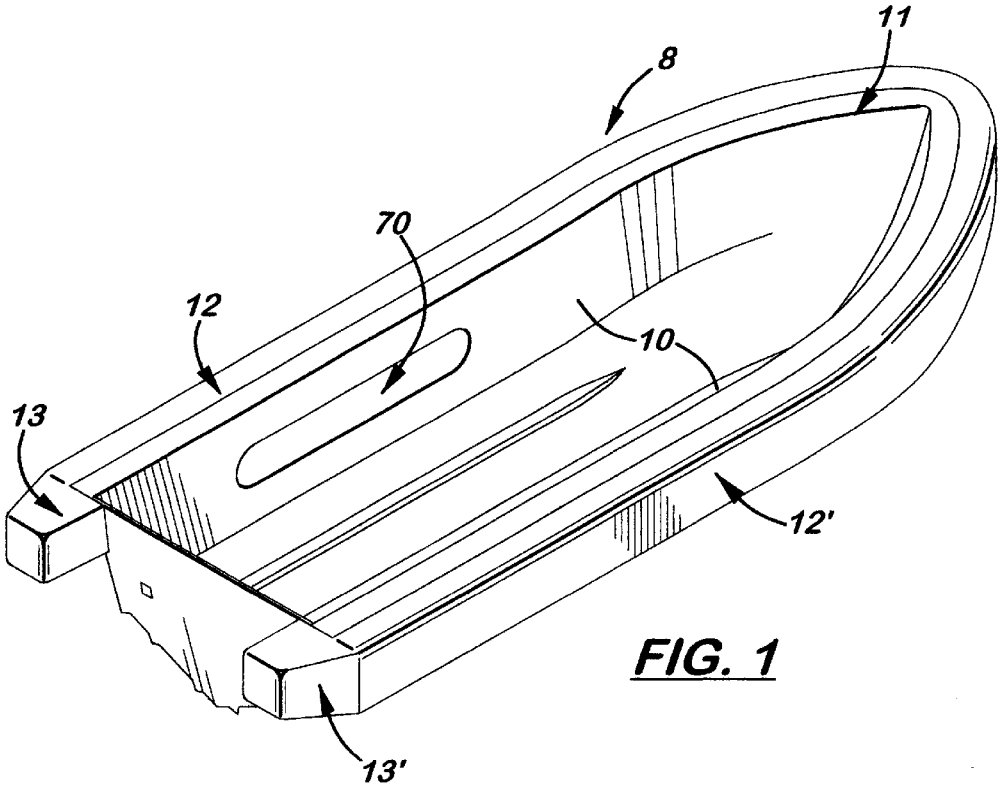
FIG. 1 is a perspective view of the boat hull disclosed herein.
Figure 2:
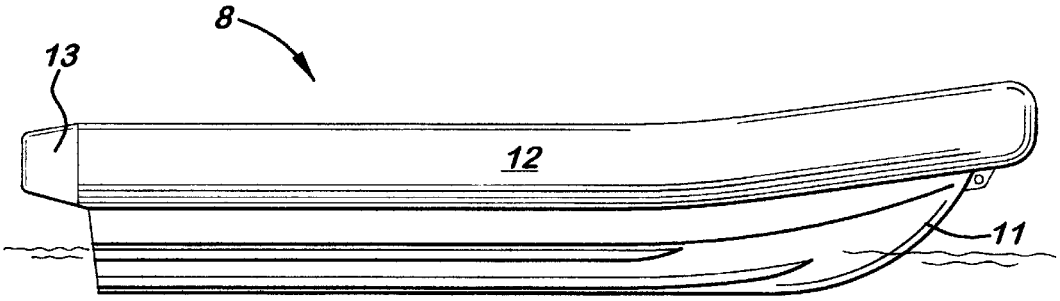
FIG. 2 is a side elevational view of the boat hull placed in a body of water.
Figure 3:
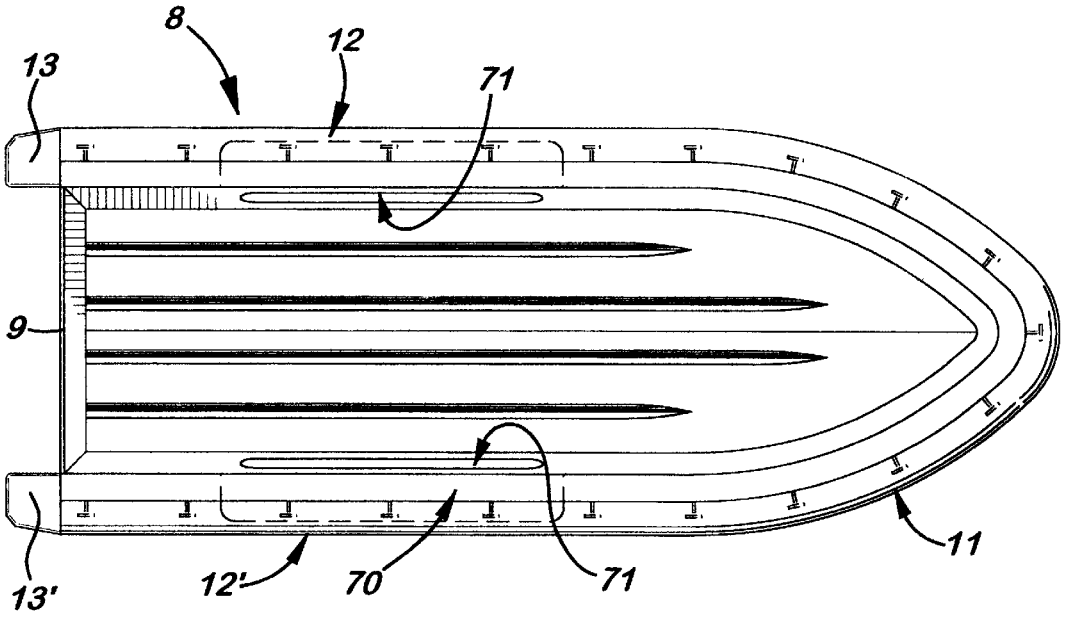
FIG. 3 is a top plan view of the boat hull.
Figure 4:
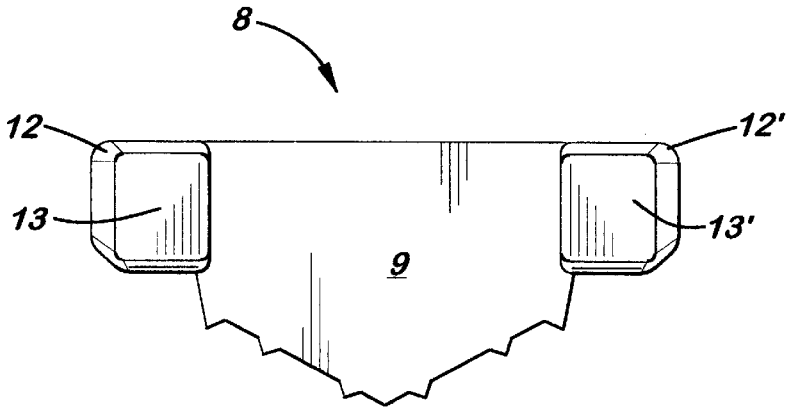
FIG. 4 is a rear elevational view of the boat hull.
Figure 5:
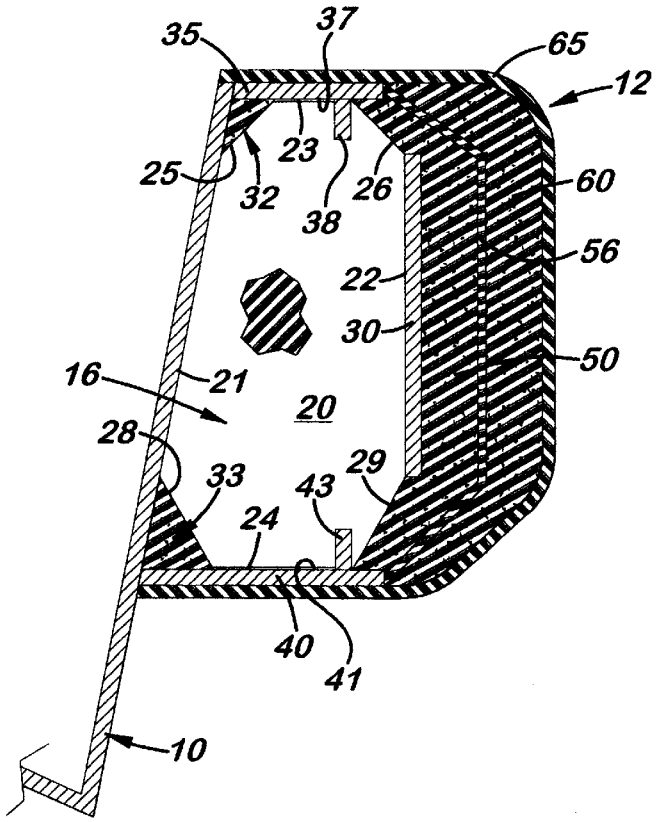
FIG. 5 is a rear sectional elevational view of the boat hull.
Figure 6:
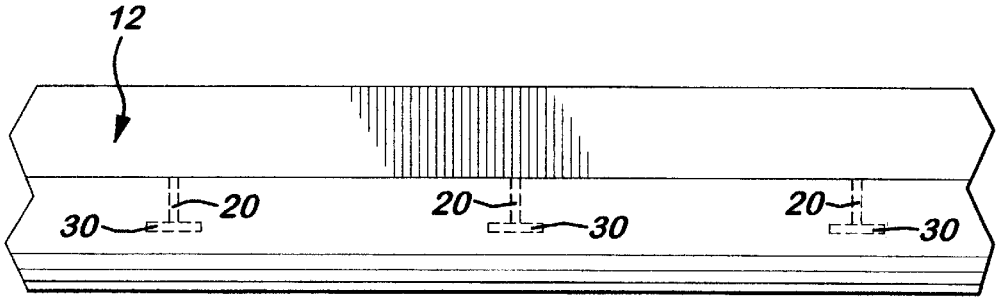
FIG. 6 is a top plan view of a side wall of the boat hull.

During the manufacturing process, all of the chambers 16 are filled with foam to create a first foam layer 50. In the preferred embodiment, the first foam layer 50 is hard, closed-cell polyurethane foam poured or sprayed into the chambers 16 until the anchor plates 30 and the stiffeners 38, 43, are imbedded, as shown in FIG. 5. In the preferred embodiment, the first foam layer is a 2 pound per cubic foot density, sprayable polyurethane foam sold by Hydroseal Polymers, Inc under the trademark HSF 210 Spray Foam. When the first foam layer 50 is cured, the upper and lower longitudinal frame members 35, 40, anchor plates 30, and stiffeners 38, 43 act to securely attach the first foam layer 50 to the hull 8. An optional fiberglass layer 56 is formed over the outer surface of the first foam layer 50 and allowed to cure.

Formed over the fiberglass layer 56 or the first foam layer 50 is a second foam layer 60. The second foam layer 60 is a flexible closed-cell polyurethane foam sold by Burtin Corporation of Santa Ana, Calif. under the trademark BUC 920-SP3.0. The density of the second foam layer 60 is 3 to 4 pounds per cubic feet. After the first foam layer 50 is cured and shaped, the exposed surfaces of the upper and lower longitudinal frame members 35, 40 and the first foam layer 50 are then sprayed with the second foam layer 60.

An outer, pigmented, polyurethane, hardening layer 65 is then applied over the second foam layer 60 to protect the second foam layer 60 and to make the bumper 12, 12' appear as an integrated component of the hull 8.

The upper and lower longitudinal frame members 35, 40 are welded along one edge surface to the side walls 10 and measure approximately four inches in width. Each upper and lower longitudinal frame member 35, 40 extends longitudinally along the entire side wall 10 from a point located 6 to 12 inches rearward of the transom 9, creating two rearward extending bumper sections 13, 13' on opposite sides of the hull 8.

The intermediate frame members 20, spaced apart at 18 to 30 inch intervals on each side wall 10, are between the upper and lower longitudinal frame members 35, 40. Each intermediate frame member 20 is octagonal as shown in FIG. 5, with parallel top and bottom surfaces 23, 24, a diagonally aligned inside surface 21, a vertically aligned outside surface 22, and four notched surfaces 25, 26, 28, 29. Attached to the inside surface of the upper longitudinal frame member 35 and the inside surface 21 of the intermediate frame member 20 is the upper stiffener 38. Attached to the inside surface of the lower longitudinal frame member 40 and the inside surface 21 of the intermediate frame member 20 is the lower stiffener 43, located directly below the upper stiffener 38. When the first foam layer 50 is poured into the chambers 16, it completely fills the chamber 16 and flows into the adjacent chambers 16 via upper and lower passageways 32, 33 formed between the side wall 10 and the intermediate frame member 20. As mentioned above, the first foam layer 50 also flows around the stiffeners 38, 43 and the anchor plates 30 thereby enabling them to act as rigid structures to prevent lateral movement or separation of the first foam layer 50 from the hull 8.

An optional storage box 70 may be created on the inside surface of each side wall 10. In the preferred embodiment, an opening 71 is formed on the inside surface of the hull 8. The storage box 70 measures approximately 2' to 6' long, 8" to 10" high, and 6" to 8" deep, is made of aluminum and extends in the chamber 16 formed on the side walls 10. The size and shape of the intermediate frame members 20 must be modified to accommodate the storage box 70.

The upper and lower longitudinal frame members 35, 40, the intermediate frame members 20, the anchor plates 30 and stiffeners 38, 43 are made of aluminum plate approximately ⅛ inches in thickness.

On a nineteen-foot boat, shown in the Figs., the finished bumper 12, 12' measures approximately sixteen to twenty inches in vertical depth. On longer boats the bumper 12, 12' may be of greater vertical depth and an additional longitudinal frame member, with an optional flat bar on the edge, is added between the lower longitudinal frame member 40 and the cap rail. The bumper 12, 12' extends laterally approximately 12 inches from the inside surface of the hull 8.

In the embodiment shown in the Figs, the hull 8 is a typical aluminum boat hull design comprised of a V-shaped design with a reverse chine of zero to 15 degrees. A plurality of longitudinal, parallel strakes is formed on each side of the centerline of the bottom of the hull 8.

Method of Manufacturing

The method of manufacturing a hull 8 with integrally attached bumpers 12, 12' comprises the following steps:

a. manufacturing a hull 8 with rigid framing 14 formed on the side walls 10 creating partially enclosed chambers 16, said rigid framing 14 including upper and lower longitudinal members 35, 40, a plurality of intermediate members 20 disposed between said upper and lower longitudinal members 35, 40, and a rigid anchor plate 30 attached to each said intermediate member 20;

b. applying a first foam layer 50 into the chambers 16;

c. applying a second foam layer 60 over the first foam layer 50; and, d. applying a polyurethane hardening layer 65 over the second foam layer 60.

The aluminum side walls 10 of the hull 8 and the framing 14 are usually roughed up with grinding pads. The first foam layer 50 (2.0-pound weight) is sprayed into the chambers 16 and over the anchor plates 30. The first foam layer 50 is then carved and shaped and may be covered with an optional layer 56 of fiberglass or KEVLAR matting with fiberglass rosin. The rosin coat repels moisture and adds impact resistance to the bumper 12, 12'.

The second foam layer 60 (3.0-pound weight) is then applied over the fiberglass layer 56 or applied to the outer surface of the first foam layer 50. Then the second foam layer 60 is allowed to cure and coated with an aliphatic modified polyurethane flexible rubber coating 65 which seals and bonds the bumper 12, 12' to the upper and lower longitudinal frame members 35, 40.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

We claim:

1. An integrated bumper boat hull, comprising:

a. an aluminum hull;

b. a plurality of chambers formed on the outside surface of said hull, each said chamber formed between upper and lower longitudinal frame members attached to said hull and an anchor plate disposed between said frame members;

c. a first foam layer longitudinally aligned on said boat hull and formed inside said chamber and around said anchor plate;

d. a second foam layer covering the exposed surfaces of said first foam layer; and, e. a hardening protective layer formed over said second foam layer and said exposed surfaces of said upper and lower longitudinal frame members.

2. The integrated bumper boat hull, as recited in claim 1, further including a pair of stiffeners attached to said upper and lower longitudinal frame members.

3. The integrated bumper boat hull, as recited in claim 1, further including at least one passageway formed on said anchor plate enabling the first foam layer located in a chamber to be formed integrally with the first foam layer on an adjacent chamber.

4. The integrated bumper boat hull, as recited in claim 1, further including a fiberglass layer formed between said first foam layer and said second foam layer.

5. The integrated bumper boat hull, as recited in claim 1, wherein said first foam layer is made of hard, closed-cell polyurethane foam.

6. The integrated bumper boat hull, as recited in claim 5, wherein said second foam layer is made of soft, closed-cell polyurethane foam.

7. The integrated bumper boat hull, as recited in claim 6, wherein said protective layer is made of polyurethane flexible rubber coating.

8. The integrated bumper boat hull, as recited in claim 7, further including a fiberglass layer formed between said first and second foam layers.

9. The integrated bumper boat hull, as recited in claim 1, further including a storage box formed in said rigid frame.

10. An integrated bumper boat hull, comprising:

a. an aluminum hull with opposite side walls;

b. outer rigid framing formed on said sidewalls, said framing including upper and lower longitudinal frame members attached to said hull and a plurality of intermediate frame members perpendicularly aligned and located between said upper and lower longitudinal frame members, said rigid framing also including an anchor plate spaced laterally from said hull thereby forming a plurality of partly enclosed chambers on said side walls capable of being filled with foam;

c. a first foam layer formed inside said chambers to cover said immediate frame member and said anchor plate, said foam layer made of made of hard, closed cell polyurethane foam.

d. a second foam layer covering the exposed surfaces of said first foam layer, said second foam layer is made of soft, closed cell polyurethane foam; and, e. a hardening protective layer formed over the exposed surfaces of said second foam layer and said upper and lower longitudinal frame members.

11. The integrated bumper boat hull, as recited in claim 10, further including a fiberglass layer formed between said first and second foam layers.

12. The integrated bumper boat hull, as recited in claim 10, wherein said protective layer is a polyurethane flexible rubber coating.

13. The integrated bumper boat hull, as recited in claim 11, further including a stiffener extending between adjacent intermediate framing members.

14. A method of manufacturing, comprising a. manufacturing a hull with outer rigid framing formed on the side walls creating partially enclosed chambers, said framing including a plurality of rigid anchor plates that resist lateral forces applied thereto;

b. applying a first foam layer into the chambers and covering the rigid anchor plates;

c. applying a second foam layer over the first foam layer; and, d. applying a polyurethane hardening layer over the second foam layer.

* * * * *